US006896400B2

(12) United States Patent
Didion

(10) Patent No.: US 6,896,400 B2
(45) Date of Patent: May 24, 2005

(54) GRANULAR PRODUCT BLENDING AND COOLING ROTARY DRUM

(75) Inventor: Charles J. Didion, St. Charles, MO (US)

(73) Assignee: Didion Manufacturing Company, St. Peters, MO (US)

( * ) Notice: Subject to any disclaimer, the term of this patent is extended or adjusted under 35 U.S.C. 154(b) by 71 days.

(21) Appl. No.: 10/336,927

(22) Filed: Jan. 7, 2003

(65) Prior Publication Data

US 2004/0130964 A1 Jul. 8, 2004

(51) Int. Cl.[7] ..... B01F 9/02; B01F 15/06

(52) U.S. Cl. ..... 366/147; 366/228

(58) Field of Search ..... 366/7, 22–25, 366/56–59, 147, 227–228, 233; 34/135–138; 432/111, 116, 117, 118

(56) References Cited

U.S. PATENT DOCUMENTS

| | | | | |
|---|---|---|---|---|
| 3,866,888 A | * | 2/1975 | Dydzyk | 366/25 |
| 3,998,262 A | | 12/1976 | Didion | |
| 4,050,635 A | | 9/1977 | Mueller et al. | |
| 4,071,962 A | * | 2/1978 | Saeman | 34/135 |
| 4,332,478 A | * | 6/1982 | Binz | 366/25 |
| 4,724,777 A | * | 2/1988 | Reed et al. | 432/118 |
| 4,787,938 A | * | 11/1988 | Hawkins | 366/22 |
| 4,981,581 A | | 1/1991 | Didion | |
| 5,016,827 A | | 5/1991 | Didion | |
| 5,095,968 A | | 3/1992 | Didion | |
| 5,538,340 A | * | 7/1996 | Brashears | 366/147 |
| 5,558,432 A | * | 9/1996 | Swisher, Jr. | 366/147 |
| 5,581,902 A | | 12/1996 | Didion et al. | |
| 5,603,567 A | * | 2/1997 | Peacock | 366/147 |
| 5,613,902 A | | 3/1997 | Didion et al. | |
| 5,664,881 A | * | 9/1997 | Hawkins et al. | 366/7 |

FOREIGN PATENT DOCUMENTS

JP 59-27953 * 2/1984

* cited by examiner

*Primary Examiner*—Charles E. Cooley
(74) *Attorney, Agent, or Firm*—Paul M. Denk

(57) ABSTRACT

A rotary drum configuration for the efficient blending, cooling, and screening of granular products having an outer cylindrical shell, an intake end, and a discharge end. The rotary drum is normally rotated at a predetermined speed by means of a conventional drive package. Disposed on an inner surface of the cylindrical shell are a plurality of compound helical flights and scoops, configured to blend granular product as it cascades from the intake end to the discharge end of the rotary drum. A coaxially disposed cylindrical air passage adjacent the discharge end of the rotary drum directs a counter flow of cooling air through the rotary drum towards the intake end, cooling the cascading granular product as it approaches the discharge end, and plurality of discharge ports and grading screens in the surface of the outer cylindrical shell adjacent the discharge end provide a entrance for a second counter flow of cooling air while simultaneously providing passage for the granular product to drop downwards towards a outer coaxial discharge passage.

1 Claim, 6 Drawing Sheets

GRANULAR PRODUCT BLENDING AND COOLING ROTARY DRUM

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates generally to a rotary drum as used in the granular product drying field, and having a major application for the treatment of heated and moist granular products such as mold sands, grains, and fertilizers as to achieve the reclaiming, cooling, and blending of the mold granular product and in particular, to a dust collection hood and discharge chute configured to convey multiple air streams through the rotary drum for the cooling of the granular product.

There are a variety of prior patents that have been obtained upon various styles of rotary drums for use in the metal casting industry. For example, one of the early embodiments is that which is shown in U.S. Pat. No. 3,998,262 to Charles J. Didion, showing a casting shakeout unit and method of operation. Essentially, such a drum is arranged upon its structural support and rotated by means of a drive unit, so that when castings clogged with mold sand as obtained directly from the site of their casting, are then passed through the rotary drum, the mold sand is effectively separated and removed from the prepared castings, to achieve the required separation without necessitating the employment of any manual labor to attain such results.

The usage of shrouds or hoods around the discharge end of the rotary drum has been employed in the prior art, as can be seen in U.S. Pat. No. 4,050,635 to Mueller, et al., wherein the shown housing incorporated an outlet chute, at is lower end, for attaining the discharge of the castings, or its sand, therefrom, during operations of the shown device. In addition, such hoods have been used for collection and removal of sand particles, to facilitate the collection of the sand in preparation for its re-usage.

Similarly, the usage of a ventilating hood on a rotary drum, having various ventilating ports designed therein so as to accommodate the flow of air around and through the discharge end of the rotary drum, for the removal of heat from sand and containment of fines and dust, while likewise diverting the separated mold sand for passage to a discharge opening, as arranged at the bottom of the ventilating hood is shown in U.S. Pat. No. 4,981,581 to Charles J. Didion.

However, it has been found that the removal of heat from hot granular products by exposure to an airflow only at the discharge end is insufficient to reduce the temperature of the granular products to near ambient temperatures. Accordingly, there is a need for a reclaiming rotary drum configuration which is capable of removing heat and moisture from granular products from the point of intake through the discharge end, to increase the heat removal, and to reduce the granular product temperature to near ambient conditions at the discharge end.

BRIEF SUMMARY OF THE INVENTION

Briefly stated, the invention sets forth a rotary drum configuration for the efficient blending, cooling, and screening of granular products. The rotary drum is of the type that is an elongated structure, generally having an outer cylindrical shell, an intake end, and a discharge end. The rotary drum is normally rotated at a predetermined speed by means of a conventional drive package. Disposed on an inner surface of the cylindrical shell are a plurality of compound helical flights and scoops, configured to blend granular product as it cascades from the intake end to the discharge end of the rotary drum. A coaxially disposed cylindrical air passage adjacent the discharge end of the rotary drum directs a counter flow of cooling air through the rotary drum towards the intake end, cooling the cascading granular product as it approaches the discharge end. A plurality of discharge ports and grading screens in the surface of the outer cylindrical shell adjacent the discharge end provide a entrance for a second counter flow of cooling air while simultaneously providing passage for the granular product to drop downwards towards a outer coaxial discharge passage. A series of external helical flights on the outer surface of the cylindrical shell urge granular product in the outer coaxial discharge passage out the discharge end of the rotary drum. The upper section of the discharge end contains an opening therethrough, and mounted in proximity with the opening, or in communication through duct work with the opening, is a vacuum pump which is designed to provide a reduced pressure for attracting air, particularly that air in which the dust and sand fines from the granular product are entrained, so as to achieve their removal.

In an alternative embodiment of the present invention, an air manifold and air pump is operatively coupled to either the cylindrical air passage, the discharge ports, or both to provide a positive pressure counter flow of air through the respective passage or ports.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
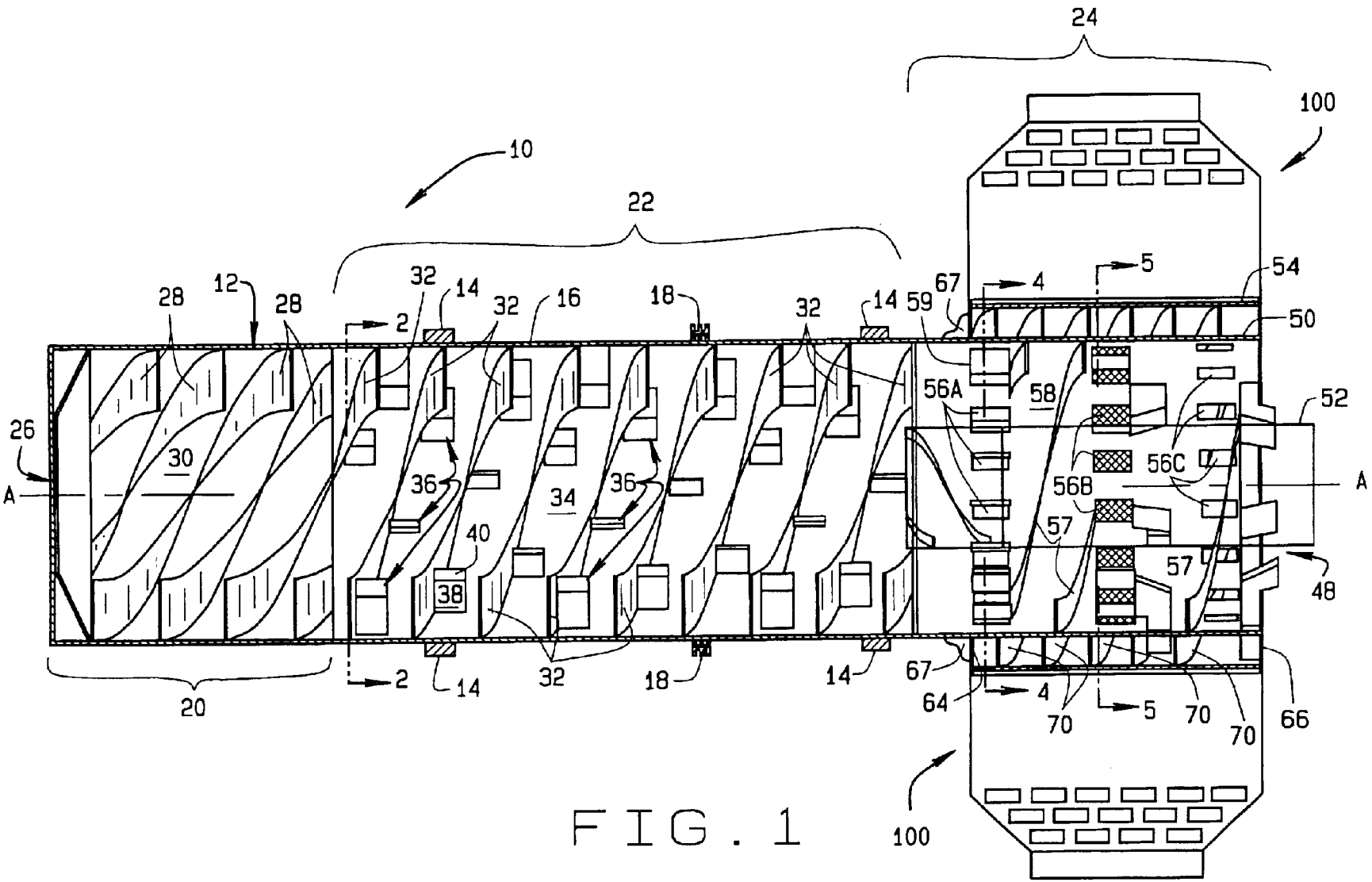
FIG. 1 is a longitudinal sectional view of a rotary cooling, blending, and screening drum.

Turning to FIG. 1, a rotary drum of the present invention for effecting the blending and cooling of granular product is shown generally at 10. The rotary media drum 10 comprises a cylindrical drum body 12, which is includes a plurality of spaced circumferential drum assembly tires 14 disposed on an external surface 16. The circumferential drum assembly tires support the rotary drum 10 on a conventional base (not shown). Correspondingly, a circumferential sprocket 18 on the external surface 16 engages a conventional drive mechanism (not shown) in the conventional base to drive the rotary drum 10 at a slow speed of rotation.

The cylindrical body 12 is preferably formed of at least three cylindrical segments 20, 22, and 24. The first segment 20 is an intake segment configured with an intake opening 26 for the intake of high temperature granular product having a high moisture content. The intake segment 20 includes a first series of helically arranged internal vanes 28 disposed on an inner surface 30 for moving the granular product longitudinally through the intake segment 20 from the intake opening 26 to the second segment 22.

The second segment 22 is a blending segment configured for the blending of the granular product in a cascading manner. The blending segment 22 including a second series of helically arranged internal vanes 32 on an inner surface 34 for moving the granular product longitudinally through the blending segment 22 from the intake segment 20 to the third segment 24. Preferably, multiple internal vanes 32 are disposed in a compound helix on the inner surface 34, to achieve a greater efficiency in moving the granular product through the blending segment 22.

Figure 2:
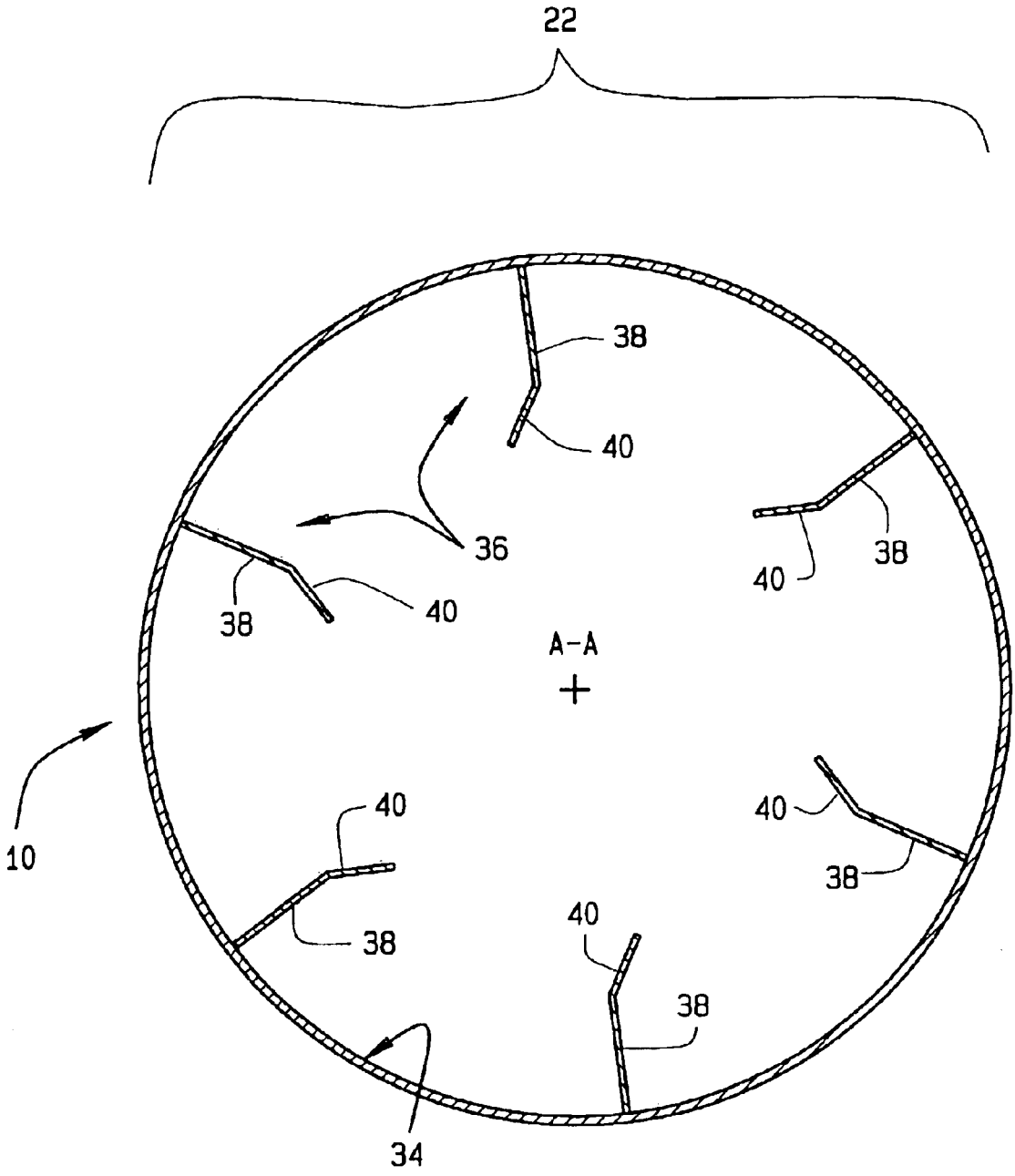
FIG. 2 is a cross sectional view of the rotary cooling, blending, and screening drum of FIG. 1, taken at line 2—2.

A plurality of scoops 36 are disposed on the inner surface 34 adjacent to, and along the length of, the second series of internal vanes 30. As best seen in FIG. 2, the spacing of the scoops 36 is selected such that the scoops 36 are spaced along the discharge side of the second series of internal vanes 30, at regular intervals about the longitudinal axis of the blending segment 22.

Each scoop 36 in the blending segment 22 consists of a base plate 38 fixed perpendicular to the inner surface 34, longitudinally aligned with the center axis of the rotary drum 10. Each base plate 38 terminates with an angled flange 40 disposed on a radially inward edge, oriented in the direction of rotation about the central axis of the rotary drum 10. As granular product flows longitudinally through the blending segment 22 along each internal vane 30 in response to the counter-clockwise rotation of the rotary drum 10, the granular product accumulates against the base plate 38 of each scoop 36. The angled flange 40, orientated in the direction of rotation, holds a portion of the granular product against the flat base portion 38 as the rotation of the rotary drum 10 lifts the granular product around the axis of rotation. As each scoop 36 approaches the highest point of rotation about the longitudinal axis of the rotary drum 10, the retained granular product spills of the angled flange 40, and cascades back to the lower portion of the blending segment 22, where it is re-mixed and blended with additional sand entering the blending segment 22. As the granular product cascades through the blending segment 22, the overall temperature and moisture content of the granular product is reduced through evaporation and heat loss.

Figure 3:
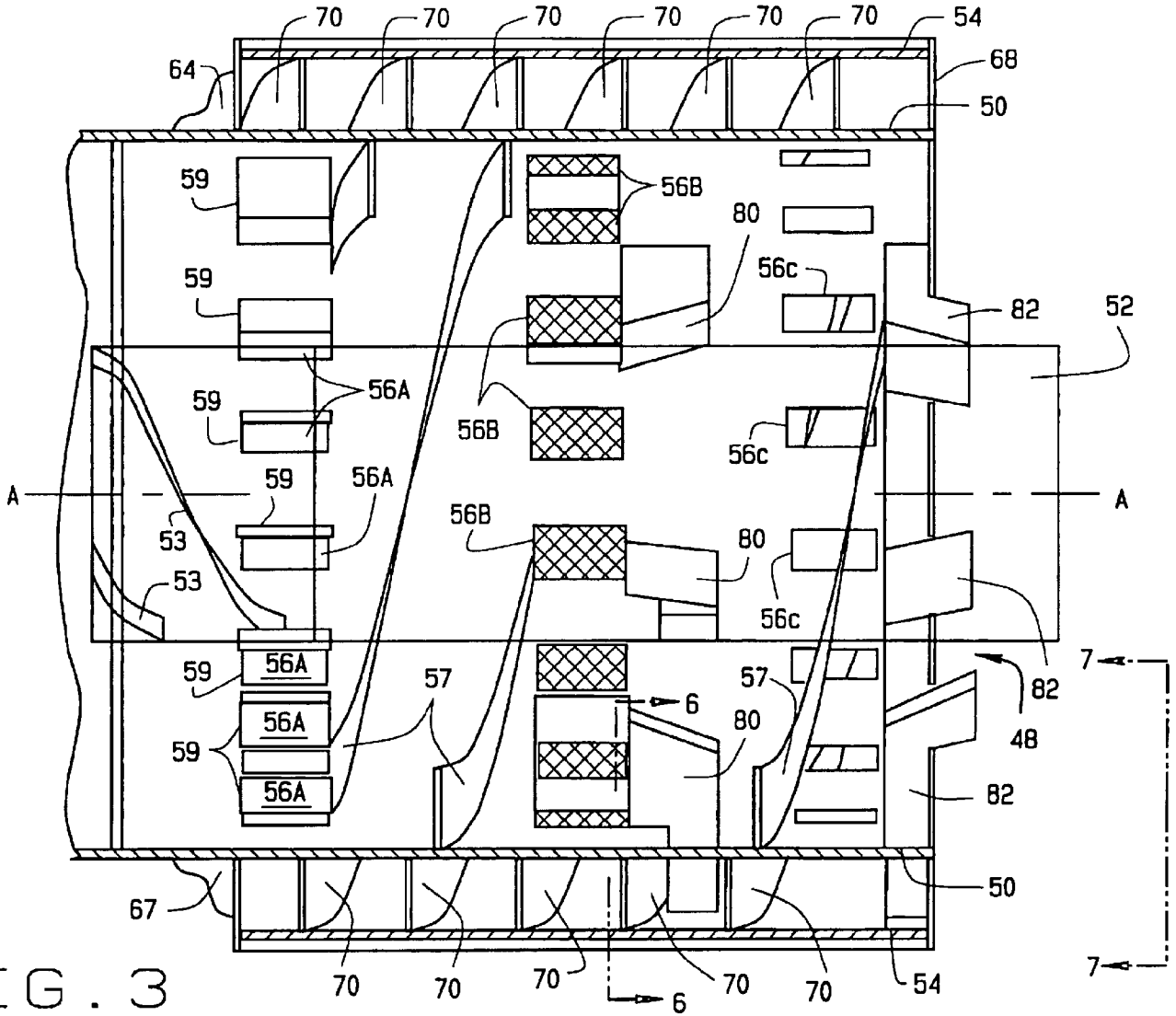
FIG. 3 is an enlarged view of the discharge segment of the rotary cooling, blending, and screening drum of FIG. 1.

Turning to FIG. 3, the third segment 24 of the rotary drum 10 is a discharge segment configured for the collection of airborne dusts and fines in the rotary drum 10 and the discharge of cooled and blended granular product through a discharge opening 48. The discharge segment 24 consists of three concentric cylinders 50, 52, and 54 and is contained within a conventional sand and dust collection hood 100, such as shown in U.S. Pat. No. 4,981,581 to Didion, herein incorporated by reference. The first cylinder 50 is defined by the cylindrical drum body 12, and includes a plurality of equidistantly spaced discharge ports 56 disposed in three sets denoted 56A, 56B, and 56C, along the longitudinal axis of the discharge segment 24. A third series of helically arranged internal vanes 57 is disposed on an inner surface 58 of the first cylinder 50 for moving the granular product longitudinally through the discharge segment 24 from the blending segment 22 to a discharge opening 48.

Figure 4:
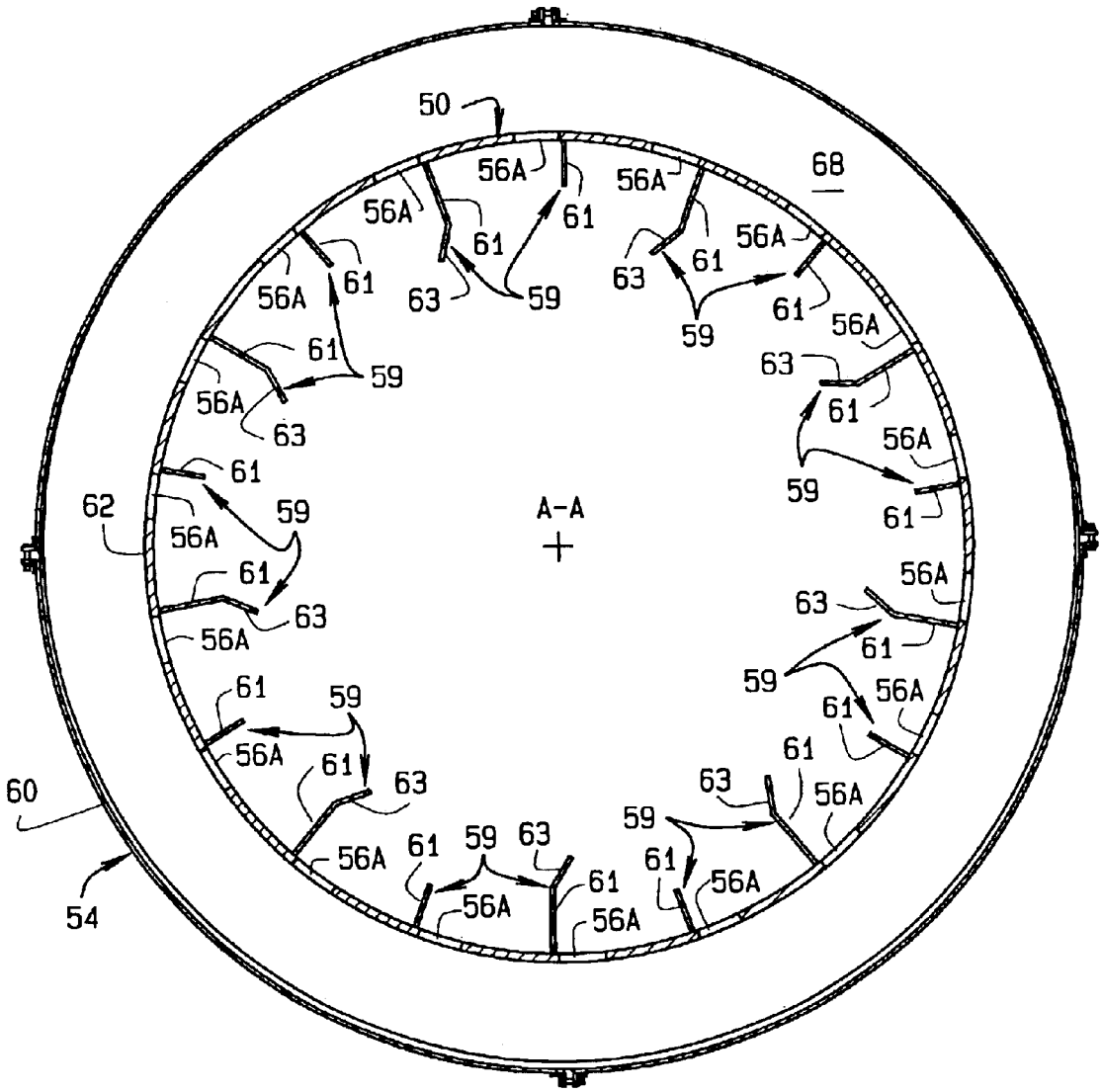
FIG. 4 is a cross sectional view of the rotary cooling, blending, and screening drum of FIG. 1, taken at line 4—4.

Adjacent each discharge port 56A in the first set, on the inner surface 58 of the first concentric cylinder 50 is a scoop 59. As best seen in FIG. 4, the spacing of the scoops 59 is selected such that the scoops 59 are at regular intervals about the longitudinal axis of the blending segment 22, corresponding to the placement of the discharge ports 56A. Each scoop 59 in the discharge segment 24 consists of a base plate 61 fixed perpendicular to the inner surface 58, longitudinally aligned with the center axis of the rotary drum 10. Alternating base plates 61 terminate with an angled flange 63 disposed on a radially inward edge, oriented in the direction of rotation about the central axis of the rotary drum 10.

Figure 5:
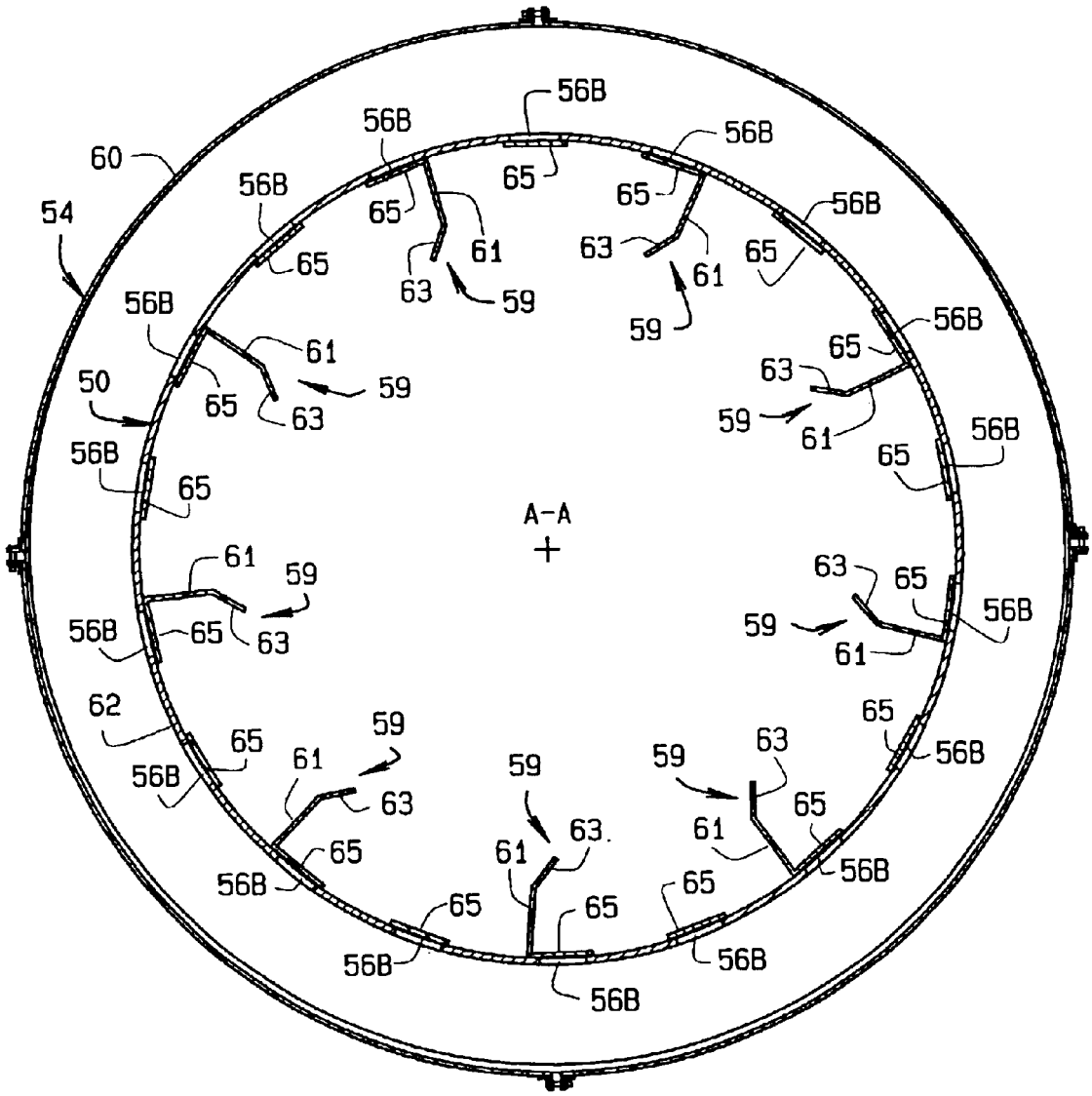
FIG. 5 is a cross sectional view of the rotary cooling, blending, and screening drum of FIG. 1, taken at line 5—5.

At the second set of discharge ports 56B, scoops 59 consisting of both a base plate 61 and an angled flange 63 are disposed adjacent alternating discharge ports 56, as best seen in FIG. 5. In addition, each discharge port 56B in the second set is covered by a mesh grill 65 having openings of a predetermined size for the passage of a portion of the granular product.

At the third set of discharge ports 56C, no scoops are present, and the openings are fully exposed, permitting passage of granular product into and out of the first concentric cylinder 50.

As granular product flows through the first concentric cylinder of the discharge segment 24, portions thereof are either directed by the scoops 59 through the discharge ports 56A or 56B, or is carried up and cascaded downward for cooling and blending by the rotation of the rotary drum 10 about the central axis.

Axially disposed with in the first cylinder 50 of the discharge segment 24, the second cylinder 52 defines an axial air duct configured to convey a longitudinal cooling air flow from a positive air flow external source, preferably adjacent the discharge opening 48, to the blending segment 22. A set of reverse helical vanes 53 is disposed within the axial air duct 52, adjacent the air discharge end in the blending segment 22. The reverse helical vanes 53 are configured to redirect any granular product falling into the air duct 52 back out into the blending segment 22. The longitudinal cooling air flow is directed counter to the longitudinal movement of the granular product through the rotary drum 10, and is exhausted out the intake opening 26 in the intake segment 20. As the longitudinal counter flow of air moves through the blending segment 22 and the intake segment 20, heat and moisture is absorbed from the granular product and conveyed out, cooling and drying the granular product as it cascades through the blending segment 22.

The third concentric cylinder 54 is disposed radially outward from the first cylinder 50 of the discharge segment 24. The third concentric cylinder 54 comprises a cylindrical screen 60 which is secured to the exterior surface 62 of the first cylinder 50 by an intake side radial flange 64 and a discharge side radial flange 66, defining a cylindrical chamber 68 between the first concentric cylinder 50 and the third concentric cylinder 54. Gussets 67 between the intake side radial flange 64 and the exterior surface 62 provide additional strength. The cylindrical chamber 68 is in communication with the interior of the first concentric cylinder 50 through the discharge ports 56A, 56B, and 56C for the entrance of granular product. The cylindrical screen 60 is selected to pass granular product particles which are smaller than a predetermined size, such as those which are suitable for re-use in a mold casting process. A series of helically arranged external vanes 70 are disposed on the exterior surface 62 of the first cylinder 50, within the cylindrical chamber 68. The external vanes 70 are configured such that the rotation of the rotary drum 10 will urge larger granular product particles contained within the cylindrical chamber 68 towards the discharge opening 48.

Cylindrical screen 60 is further configured to permit a radial flow of air from the lower region of the conventional sand and dust collection hood 100 into the cylindrical chamber 68, and a radial flow of air from the cylindrical chamber 68 into the upper region of the conventional sand and dust collection hood 100. The radial inward and upward flow of air passes through the cylindrical screen 60 radially counter flow to the outward movement of granular product particles, and into the cylindrical chamber 68. The flow of air then continues around the external vanes 70 and through the discharge ports 56, into the interior of the first concentric cylinder 50. Continuing upward, the flow of air move around the second concentric cylinder 52 and follows the reverse sequence to exit at the upper portion of the conventional sand and dust collection hood 100. As the flow air passes radially through the cylindrical chamber 68, it entrains sand fines and dust, and absorbs additional quantities of heat and moisture from the granular product, which are then evacuated from the rotary drum 10 for filtering and recovery.

In an alternate embodiment, suitable for demanding cooling and moisture reduction applications, a conventional blower or fan (not shown) can be coupled to the lower portion of the conventional sand and dust collection hood 100 to provide for a more upward positive airflow in and through the discharge segment 24.

Figure 6:
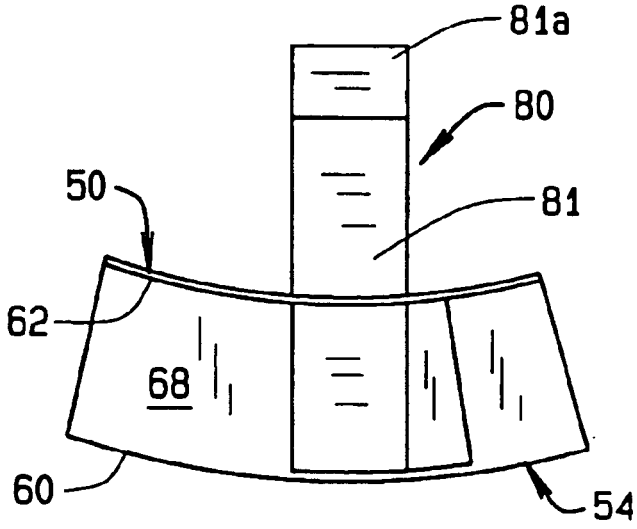
FIG. 6 is a component view of the reverse scoop assembly within the discharge segment taken along the line 6—6 of FIG. 3.

Additionally included within the discharge segment 24 of the preferred embodiment are a plurality of reverse scoop assemblies 80 and discharge scoop assemblies 82. As seen in FIG. 6, each reverse scoop assembly 80 consists of scoop 81 and a reverse blade 81a. Each reverse scoop assembly 80 is configured to redirect granular product within the discharge segment 24, which has not yet passed through the cylindrical screen 60 back within the discharge segment 24 for additional circulation and break-down.

Figure 7:
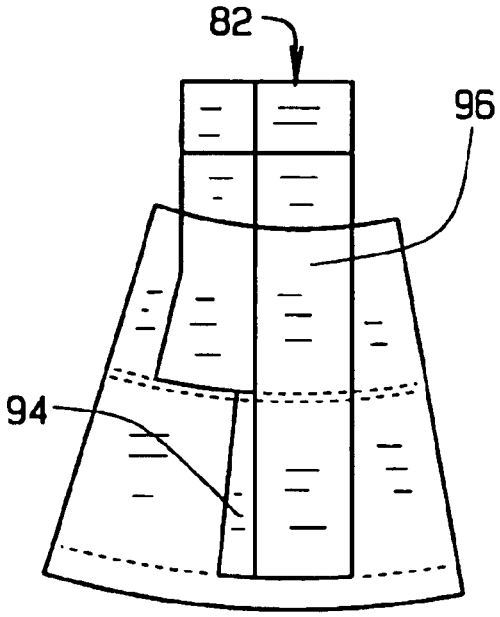
FIG. 7 is a component view of the discharge scoop assembly taken along the line 7—7 of FIG. 3.

Each discharge scoop assembly 82, shown in FIG. 7, is disposed adjacent the discharge opening 48 of the discharge segment 24, and consists of a first inclined plate 94 disposed in the cylindrical chamber 68, and a second inclined plate 96 disposed adjacent the inner surface 58. The first inclined plate 94 is configured to direct granular product accumulating adjacent thereto within the cylindrical chamber 68 in a radially inward direction, towards the discharge opening 48. Correspondingly, the second inclined plate 96 is configured to direct granular product accumulating adjacent thereto within the first concentric cylinder radially inward and towards the discharge opening 48, where it is discharged from the rotary drum 10.

Returning to FIG. 1, during operation of the rotary drum 10 of the present invention, heated and wet granular product is conveyed to the intake opening 26 and deposited within the intake segment 20. Rotating motion of the rotary drum 10 causes the a first series of helically arranged internal vanes 28 to mix and homogenize the granular product thoroughly, and to move it longitudinally through the intake segment 20 towards the blending segment 22. As the sand cascades downstream through the main blending segment 22 of the rotary drum, the counter flow of air passing therethrough from the air duct 52 evaporates moisture present in the sand, cooling it. The rotating, lifting, and cascading action of the second series of helically arranged internal vanes 30 and scoops 36 provides constant exposure of fresh surface area to the longitudinal counter flow of air to achieve a high degree of sand cooling. Additionally, the back blending and intermixing within the blending segment 22 blends the various zones of the granular product such that the granular product is consistent in temperature and moisture content upon exiting the blending segment 22 and entering the discharge segment 24.

Once in the discharge segment 24, portions of the granular product are urged through the discharge ports 56A, 56B, and 56C by the interaction of the third series of helically arranged internal vanes 57 and the scoops 59. Portions of granular product passing through the discharge ports 56A and 56B and into the cylindrical chamber 68 passes downward through the cylindrical screen 60 and exits the rotary drum 10. Particles of granular product which are to large to pass through the cylindrical screen 60 are urged towards the discharge end of the rotary drum 10 by the series of helically arranged external vanes 70. At the discharge end, the remaining granular product, generally consisting of particles to large to pass through the cylindrical screen 60, is discharged from the rotary drum 10 by interaction with the discharge scoops 82 disposed adjacent the discharge opening 48.

To further cool and dry the granular product, and to remove fines or dusts contained therein, a second counter flow of air is directed through the granular product in the discharge chamber 24. The second counter flow of air generally enters the discharge chamber through the lower portion of the conventional sand and dust collection hood, passes through the cylindrical screen 60, and into the discharge ports 56A, 56B, and 56C below the axis of the rotary drum 10. The air circulates around the coaxial air duct 52, and passes upward through the discharge ports 56A, 56B, and 56C above the axis of the rotary drum, again passing through the cylindrical chamber 68 and exiting the discharge chamber 24 through the upper portion of the conventional sand and dust collection hood 100, carrying with it entrained particles, dust, moisture, and absorbed heat from the granular product. The duct 52 is a solid cylindrical member. Generally, it does not have any vents therethrough. On the other hand, in an alternative embodiment, one or more screens may be provided within the air duct 52, and allow some air to circulate through it, to remove dust. But, in the preferred embodiment, the air duct 52 will be opened only at its ends.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A rotary media drum for effecting the blending and cooling of granular product, comprising: a rotary drum configured for slow speed rotation; said rotary drum having a cylindrical body formed of at least three segments, the first segment being an intake segment provided for the intake of granular product, the intake segment including a first series of helically arranged internal vanes for moving the granular product longitudinally therealong, the second segment being a blending segment provided for the blending of the granular product, the blending segment including a second series of helically arranged internal vanes for moving the granular product longitudinally therealong, and a plurality of scoops disposed adjacent said second series of internal vanes, said scoops configured to circulate said granular product; and the third segment including a third series of helically arranged internal vanes for moving the granular product longitudinally therealong, a plurality of discharge ports configured to selectively discharge portions of the granular product, and a first series of helically arranged external vanes for moving said discharged portions of the granular product longitudinally therealong, said third segment further including a internally disposed coaxial air duct configured to pass longitudinal counter flow cooling air from an external source into said blending segment for discharge through said intake segment; and said third segment configured in a lower portion to pass radial counter flow cooling air from an external source into said cylindrical body through said discharge ports, and in an upper portion to extract said radial counter flow cooling air from said cylindrical body through said discharge ports for external exhaustion.

* * * * *